US006541907B1

(12) United States Patent
Onishi

(10) Patent No.: US 6,541,907 B1
(45) Date of Patent: Apr. 1, 2003

(54) IMAGE FORMING APPARATUS

(75) Inventor: Tomoya Onishi, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/511,241

(22) Filed: Feb. 23, 2000

(30) Foreign Application Priority Data

Mar. 4, 1999 (JP) ..... 11-057050
Feb. 14, 2000 (JP) ..... 2000-039801

(51) Int. Cl.[7] ..... H01J 1/62
(52) U.S. Cl. ..... 313/496; 313/495; 313/461; 313/470; 313/472
(58) Field of Search ..... 313/495, 496, 313/461, 470, 472

(56) References Cited

U.S. PATENT DOCUMENTS 5,814,934 A * 9/1998 Tsai ..... 313/309
6,163,108 A * 12/2000 Toki et al. ..... 313/496

* cited by examiner

*Primary Examiner*—Sandra O'Shea
*Assistant Examiner*—Guiyoung Lee
(74) *Attorney, Agent, or Firm*—Fitzpatrick, Cella, Harper & Scinto

(57) ABSTRACT

There is disclosed an image forming apparatus in which electric discharge by a peeled metal back film is prevented. In the image forming apparatus provided with a rear plate having an electron emitting device, and a face plate having a conductive film and a fluorescent layer having fluorescent particles, the conductive film is disposed on the fluorescent layer. When an average thickness of the fluorescent layer is set to d, an average particle diameter of the fluorescent particles is rp, and the thickness of the fluorescent film is D, $D-rp \leqq d \leqq D+rp$ is satisfied.

11 Claims, 12 Drawing Sheets

IMAGE FORMING APPARATUS

BACKGROUND OF THE INVENTION

1. Field of the Invention

The present invention relates to an image forming apparatus utilizing electron beams.

2. Related Background Art

In an image forming apparatus including a cathode ray tube (CRT), further size enlargement has been demanded and researches have intensively been performed. Moreover, with the size enlargement, the thinning, lightening and cost reduction of the apparatus have become an important problem. However, since the CRT deflects the electrons accelerated with a high voltage with a deflecting electrode, and excites phosphors on a face place, in principle, a depth is necessary for the size enlargement, and it is difficult to provide a thin and light apparatus. As the image forming apparatus which can solve the above-described problem, the inventors have researched a surface conduction electron emitting device, and an image display using the surface conduction electron emitting device.

The inventors have attempted applying a multi-electron beam source by an electric wiring method, for example, as shown in FIG. 11. Specifically, a multiplicity of surface conduction electron emitting devices are two-dimensionally arranged, and these devices are wired in a simple matrix form as shown in FIG. 11 to form the multi-electron beam source.

In FIG. 11, numeral 4001 schematically denotes the surface conduction electron emitting device, 4002 denotes a row direction wiring, and 4003 denotes a column direction wiring. Additionally, for convenience of the drawing, a 6×6 matrix is shown, but the scale of the matrix is not limited to this, and a sufficient number of devices for performing a desired image display are arranged and wired.

FIG. 12 shows the structure of the image forming apparatus using the multi-electron beam source, and the structure includes a rear plate 4005 provided with a multi-electron beam source 4001, an outer frame 4007, a face plate 4006 provide with a fluorescent layer 4008, and a conductive member (metal back) 4009. Moreover, a high voltage of several kilovolts to several tens of kilovolts is applied to the conductive member (metal back) 4009 disposed on the face plate 4006 via a high-voltage introduction terminal 4011 from a high-voltage power source 4010.

In order to output desired electron beams in the multi-electron beam source in which the surface conduction electron emitting devices are wired in the simple matrix, appropriate electric signals are applied to the row direction wiring 4002 and the column direction wiring 4003. For example, to drive one arbitrary row of surface conduction electron emitting devices in the matrix, a selection voltage Vs is applied to the row direction wiring 4002 of the selected row, and additionally a non-selection voltage Vns is applied to the row direction wiring 4002 of a non-selected row. In synchronization with this, a drive voltage Ve is applied to the column direction wiring 4003 to output the electron beams. According to this method, a voltage Ve-Vs is applied to the surface conduction electron emitting devices of the selected row, and a voltage Ve-Vns is applied to the surface conduction electron emitting devices of the non-selected row. When Ve, Vs, Vns are set to voltages with appropriate magnitudes, the electron beams with desired intensities are outputted only from the surface conduction electron emitting devices of the selected row. Moreover, when different drive voltages Ve are applied to the column direction wirings, the electron beams with different intensities are outputted from the devices of the selected row. Moreover, since the response rate of the surface conduction electron emitting device is high, by changing a time length for applying the drive voltage Ve, the time length for outputting the electron beams can also be changed.

The electron beams outputted from the multi-electron beam source 4001 by applying the voltage as described above are radiated to the conductive member (metal back) 4009 to which a high voltage Va is applied, so that the fluorescent layer (image forming member) 4008 as a target is excited to emit light. Therefore, for example, by appropriately applying a voltage signal in accordance with image information, an image display is constituted.

The image forming apparatus applies the high voltage Va to the conductive member (metal back) 4009, produces an electric field between the rear plate 4005 and the face plate 4006 to accelerate the electrons, and excites the fluorescent material to emit light so that an image is formed.

Here, to realize the thinning of the image forming apparatus, the thickness of the image forming apparatus needs to be reduced, and for this purpose a distance between the rear plate 4005 and the face plate 4006 has to be reduced. Since the interval between the rear plate 4005 and the face plate 4006 is set to about several millimeters, a high electric field of 1 kV/mm or more is produced between the rear plate 4005 and the face plate 4006.

The conductive member (metal back) 4009 has a purpose of applying the high voltage Va to the entire fluorescent layer, preventing the fluorescent material from being charged, and extracting the light emitted rearward (rear plate direction) from the fluorescent material toward the front by a mirror surface effect. Therefore, the conductive member (metal back) is preferably a continuous film. Moreover, the metal back 4009 needs to be a very thin film because the accelerated electrons have to be passed through the metal back 4009 to excite the fluorescent material. However, the fluorescent material is usually powder, the fluorescent film becomes porous, and considerable surface irregularities are present.

Moreover, particularly when the fluorescent materials of three primary colors (red, blue, green) are disposed as the fluorescent film, a black interval defining member (black matrix or black stripe) is usually disposed between the color fluorescent materials in order to prevent a mixed color between the color fluorescent materials, define the interval between the color fluorescent materials, prevent color deviation from occurring even when the electron beam position slightly deviates, and to absorb external light and enhance image contrast, and for other reasons. The considerable irregularities are also present on the surface of the interval defining member.

For the above-described reasons, a filming process is usually performed before the conductive member (metal back) is prepared, because the continuous film cannot be formed by directly forming the film of the conductive member (metal back) 4009.

The filming process comprises preparing an acrylic resin film on the surface of the fluorescent layer, and flatting the surface of the fluorescent layer. Subsequently, by forming a film of conductive member on the flatted film by a vacuum deposition process or the like, the conductive member (metal back) can be prepared as the continuous film. Moreover, after the conductive member (metal back) is prepared, the resin film is calcined and removed by thermal decomposition.

SUMMARY OF THE INVENTION

There is provided an image forming apparatus comprising: a rear plate having an electron emitting device; and a face plate having a conductive film, and a fluorescent layer comprising fluorescent particles, the conductive film being disposed on the fluorescent layer. When the average thickness of the fluorescent layer is set to d, the average particle diameter of the fluorescent particles is rp, and the thickness of the fluorescent layer is D, $D-rp \leqq d \leqq D+rp$ is satisfied.

Moreover, in the image forming apparatus of the present invention, the fluorescent layer includes a fluorescent film, and an interval defining member adjacent to the fluorescent film. When the average thickness of the fluorescent film is set to tp, and the average thickness of the interval defining member is tb, $tp-rp \leqq tb \leqq tp+rp$ is satisfied.

Furthermore, in the image forming apparatus of the present invention, the fluorescent layer includes a fluorescent film, and an interval defining member adjacent to the fluorescent film, the interval defining member is constituted of a first interval defining member and a second interval defining member formed of a material different from the material of the first interval defining member, and the second interval defining member is laminated on the first interval defining member.

Additionally, in the image forming apparatus of the present invention, the second interval defining member is constituted of a particle aggregate. When the average particle diameter of the particles constituting the second interval defining member is set to rz, $0.5 \times rp < rz < 2 \times rp$ is satisfied.

Moreover, in the image forming apparatus of the present invention, the diffusion reflectance of the second interval defining member is 70% or more.

Furthermore, in the image forming apparatus of the present invention, the face plate includes a plurality of recesses, and the recesses are filled with a part of the fluorescent layer.

Additionally, in the image forming apparatus of the present invention, the fluorescent layer includes a fluorescent film and an interval defining member adjacent to the fluorescent film, and the recesses are filled with the fluorescent film.

Moreover, in the image forming apparatus of the present invention, the fluorescent layer includes a fluorescent film and an interval defining member adjacent to the fluorescent film, and the interval defining member is covered with the adjacent fluorescent film.

Furthermore, in the image forming apparatus of the present invention, the fluorescent film has fluorescent films of three colors, and the fluorescent film covering the interval defining member occupies 80% or more of the interval defining member by the fluorescent film of one color of the three colors.

Additionally, in the image forming apparatus of the present invention, the adjacent fluorescent films are formed of two different types of fluorescent films, and the area ratio of the interval defining member covered with the two types of fluorescent films is in a range of (4 to 9.5):(6 to 0.5).

DETAILED DESCRIPTION OF THE PREFERRED EMBODIMENTS

Since the conductive member (metal back) 4009 is prepared by the above-described process, the adhering force of the conductive member (metal back) 4009 to the fluorescent film and interval defining member is weakened.

Specifically, since the resin film layer present in the preparing process is thermally decomposed and removed by a baking process, a gap is produced between the conductive member (metal back) and the fluorescent film or the interval defining member in some of the materials and structures of the fluorescent material and interval defining member, and a region is produced in some cases in which the contact region of the conductive member (metal back) and the fluorescent film or the interval defining member hardly exists.

Therefore, when the electric field intensity between the rear plate 4005 and the face plate 4006 increases, the following problem occurs.

Specifically, a high voltage Va of several kilovolts to several tens of kilovolts is applied to the metal back 4009, while the rear plate 4005 substantially has GND potential. Therefore, a coulomb attracting force is generated in the conductive member (metal back).

When there is only a small contact portion between the conductive member (metal back) and the fluorescent film (the metal back is in a lifted state), the force applied to one contact portion between the conductive member (metal back) and the fluorescent film increases. As a result, the conductive member (metal back) is peeled by the coulomb force, and peeled off toward the rear plate.

Consequently, the pixel of the portion from which the conductive member (metal back) peels off is not displayed, and the image quality is deteriorated. Moreover, the conductive member (metal back) peeled off toward the rear plate inhibits the electron emission from electron emitting devices. Furthermore, since electric discharge occurs between the rear plate and the face plate, the function of the image forming apparatus is deteriorated.

The image forming apparatus of the present invention has been developed in consideration of the above-described problems.

An embodiment of the image forming apparatus of the present invention will be described hereinafter with reference to the drawings.

Figure 9:
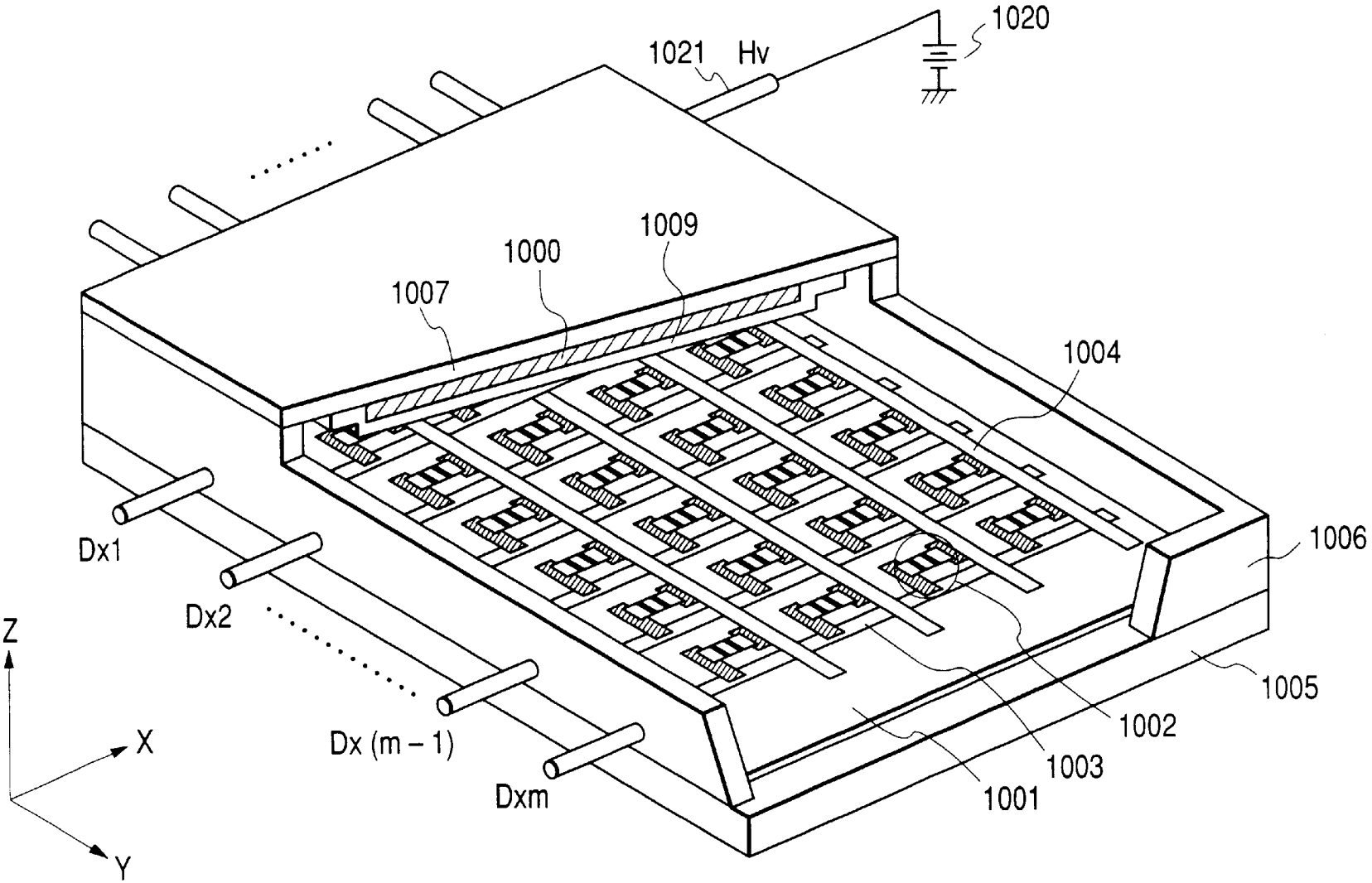
FIG. 9 is a partially cut perspective view showing the display panel of an image display according to the embodiment of the present invention.
Figure 10A:
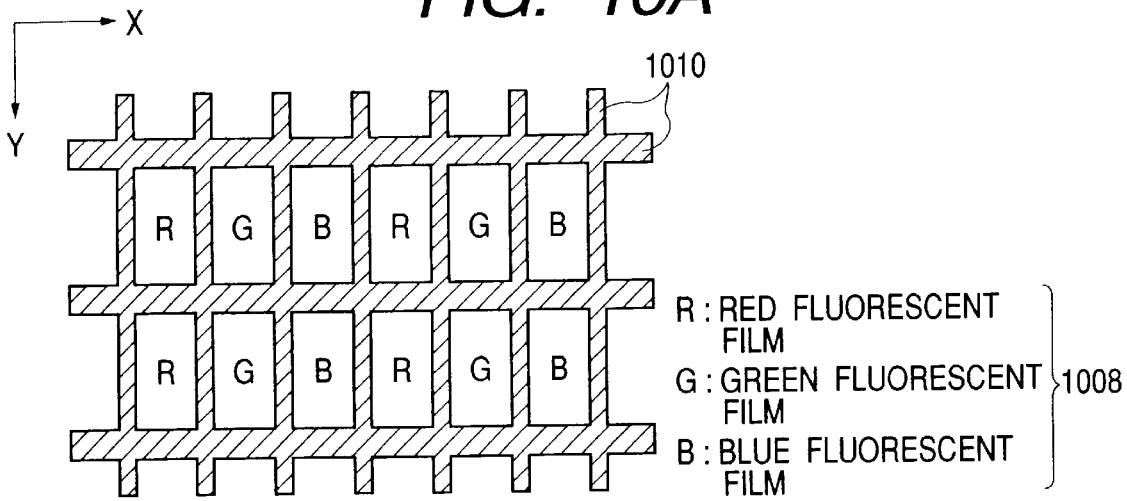
FIGS. 10A, 10B and 10C are plan views showing the arrangement of fluorescent materials on the face plate of the display panel.
Figure 10B:
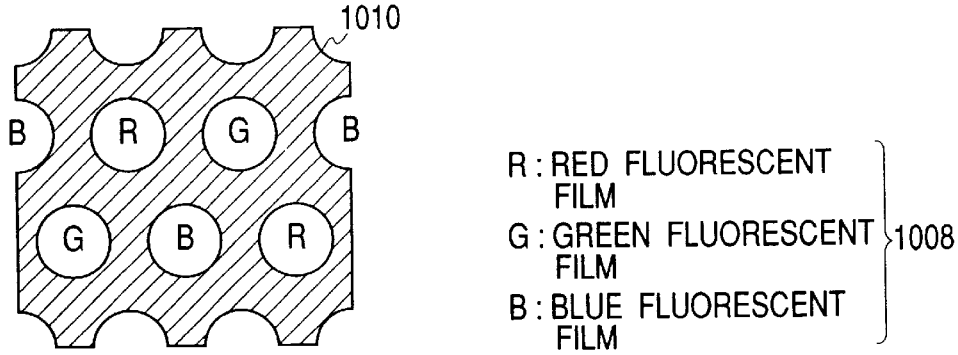
Figure 10C:
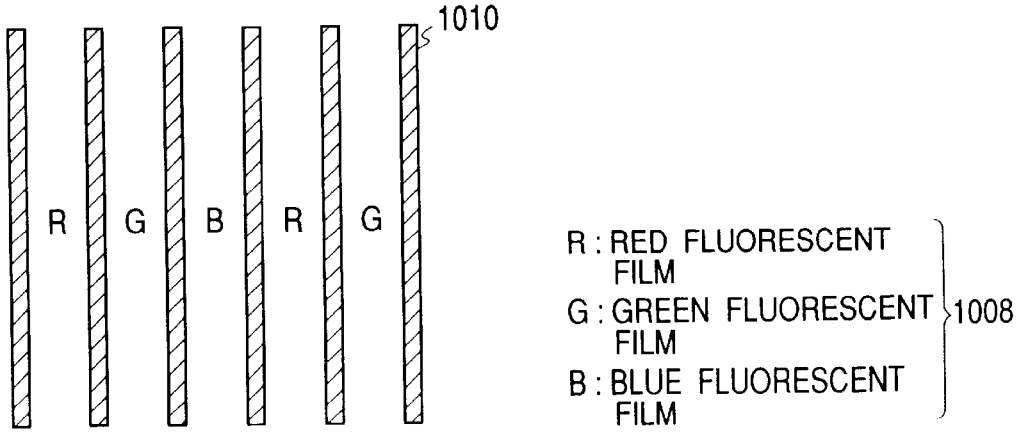
Figure 11:
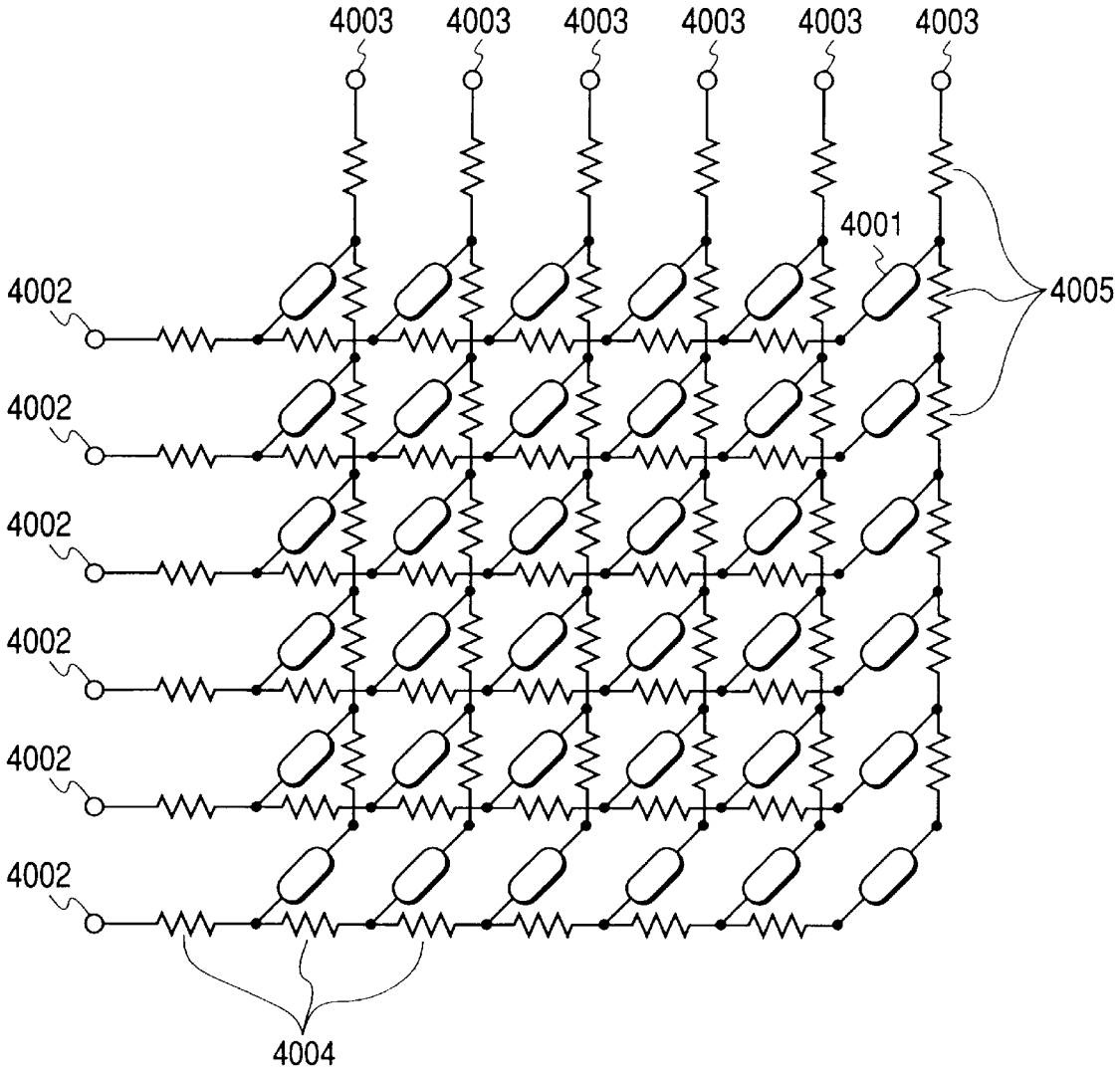
FIG. 11 is a diagram showing the matrix wiring connection of surface conduction electron emitting devices.
Figure 12:
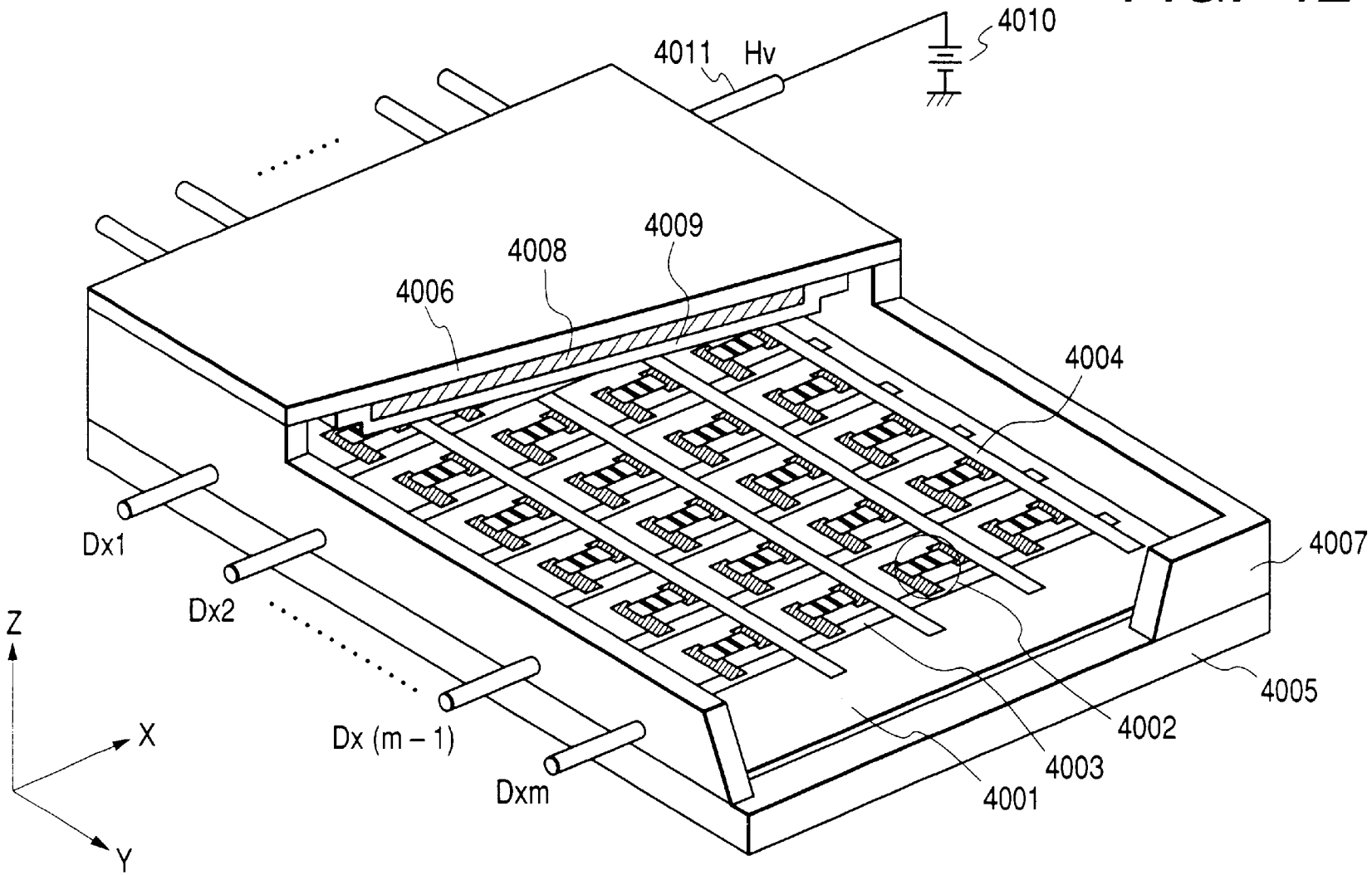
FIG. 12 is a partially cut perspective view of the display panel of a conventional image display.

FIG. 9 is a perspective view showing one embodiment of the image forming apparatus to which the present invention is preferably applied, and a part of the apparatus is cut for the sake of convenience of description. FIGS. 10A to 10C show one example of the face plate to which the present invention can preferably be applied. A face plate 1007 is a flat transparent substrate, and has a first major surface and a second major surface. A fluorescent film, or a fluorescent layer 1000 constituted of the fluorescent film and an interval defining member is formed on the first major surface, and a conductive member (metal back) 1009 is disposed on the fluorescent layer 1000. Here, the fluorescent film indicates an aggregate (group) of fluorescent particles.

FIGS. 10A to 10C are schematic views of the face plate 1007 as seen from the side of a rear plate 1005. Also in the present invention, an interval defining member 1010 is preferably used as shown in the prior art. FIGS. 10A, 10B show that the interval defining members 1010 between fluorescent films 1008 are arranged in a matrix form, and show a so-called black matrix. FIG. 10C shows the arrangement of the interval defining members 1010 in a stripe form, and shows a so-called black stripe. The interval defining member 1010 is of any color as long as contrast can be enhanced, but is preferably black. Moreover, when the black member is used, at least a surface contacting the face plate 1007 may be black, and all the interval defining members 1010 do not need to be constituted of the black members. In the present invention, any one of the arrangements shown in FIGS. 10A to 10C may be used. Moreover, the present invention is not limited to the structures shown in FIGS. 10A to 10C, and other arrangements may be used. Furthermore, the present invention is not limited to color display, and may preferably be applied to a monochromatic display image forming apparatus.

The fluorescent film 1008 is an the aggregate (group) of fluorescent particles, and is disposed on the first major surface of the face plate. The conductive member (metal back) 1009 is a continuous film, preferably a metal film, more preferably an aluminum film. Moreover, the film thickness of the conductive member 1009 is in a range of several hundreds of angstroms to several thousands of angstroms, preferably 100 to 1000 angstroms, more preferably 200 to 500 angstroms. Furthermore, the voltage applied to the conductive member 1009 is in a range of 1 to 20 kV, preferably 6 to 15 kV in consideration of the electric discharge (dielectric breakdown), the emitting luminance of the fluorescent material, and the like. The interval defining member 1010 is formed, for example, of a mixture of glass and black pigment, but the material is not particularly limited. The interval defining member 1010 is disposed between sub-pixels or between pixels. Here, in the color display, the fluorescent film of three primary colors, red (R), green (G), and blue (B) are necessary, and these three primary color fluorescent films are arranged/formed with some regularities, In the present invention, an area formed of each color fluorescent material is called "sub-pixel". Moreover, in the present invention, the "pixel" in the color display image forming apparatus indicates an area having one unit of three adjacent sub-pixels RGB. On the other hand, since only the single fluorescent material is used in the monochromatic display, the unit sub-pixel and the unit pixel are not particularly distinguished.

The image forming apparatus of the present invention includes the fluorescent layer 1000 disposed on the first major surface of the face plate and the conductive member (metal back) 1009 disposed on the fluorescent layer. When the average height (thickness) of the fluorescent layer 1000 is set to d, the average particle diameter of the fluorescent particles constituting the fluorescent layer is rp, and the film thickness of the fluorescent layer is D, in the fluorescent layer (particularly, in any place of the fluorescent layer), the following is satisfied:

$$D-rp \leqq d \leqq D+rp \qquad \text{Equation (1)}$$

Here, the "average particle diameter" in the present invention indicates a median diameter Dmed, and the number of particles whose diameters are larger than the diameter (average particle diameter) is equal to the number of particles whose diameters are smaller than the diameter (average particle diameter). The "average particle diameter" used hereinafter is also a value represented by the median diameter.

Moreover, the "average height (average thickness)" of a certain constituting member in the present invention indicates a difference between the position of the average line of the sectional shape of the constituting member in one pixel measured with a probe type surface roughness meter, and a reference surface. Particularly when the object area is constituted of a plurality of constituting members without limiting the constituting member, the average height of each constituting member is measured, and the average height of the object area is obtained by averaging the average heights of all the constituting members.

Furthermore, the fluorescent layer indicates a layer including the fluorescent film constituted of at least fluorescent particles. When there is a constituting member adjacent to the fluorescent film, the layer including the constituting member is called the fluorescent layer.

The constitutions of first to fourth image forming apparatuses satisfying the present invention will concretely be described hereinafter with reference to the drawings.

Figure 1:
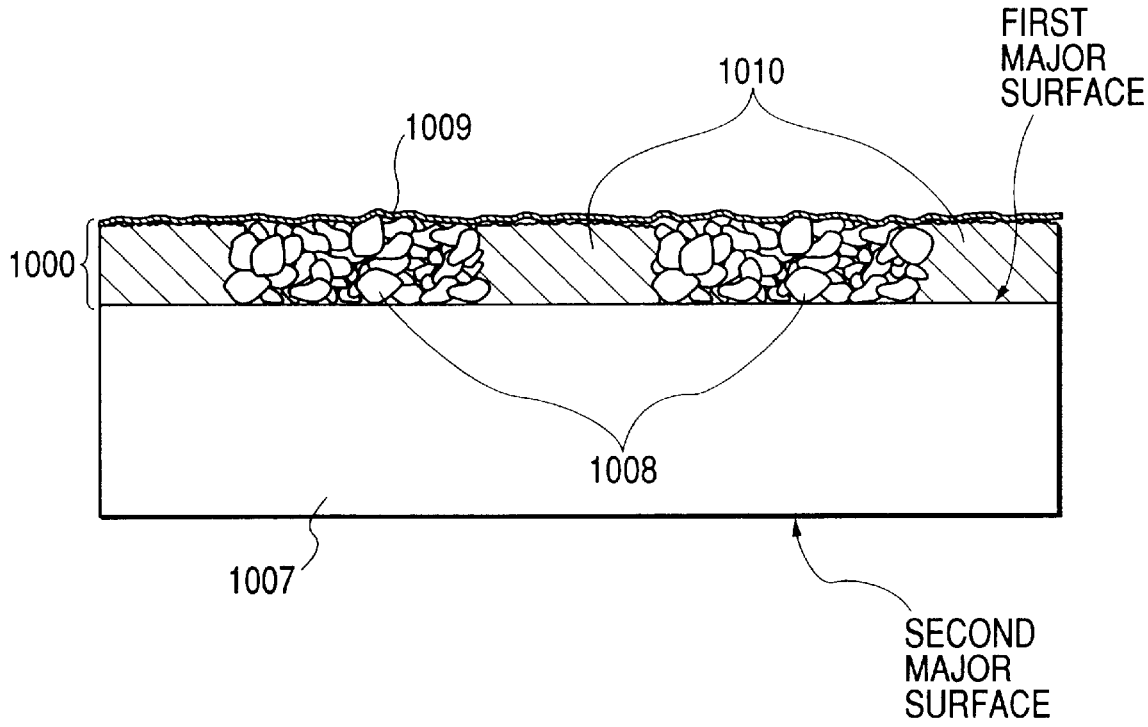
FIG. 1 is a schematic sectional view showing a face plate and a metal back according to an embodiment of the present invention.

FIG. 1 is a diagram showing the face plate of a first image forming apparatus of the present invention, and shows one example of a schematic sectional view.

As shown in FIG. 1, in the first image forming apparatus of the present invention, the fluorescent film 1008 is disposed on the first major surface of the face plate 1007. The fluorescent film is an aggregate (group) of fluorescent particles. Numeral 1009 denotes a continuous film formed of the conductive member (metal back). Numeral 1010 denotes an interval defining member.

Furthermore, in the first embodiment of the present invention, when the average thickness of the fluorescent film 1008 is set to tp ($\mu$m), the average thickness of the interval defining member 1010 adjacent to the fluorescent film 1008 is tb ($\mu$m), and the average particle diameter of the fluorescent particles is rp ($\mu$m), the average thickness tb of the interval defining member satisfies:

$$tp-rp<tb<tp+rp \qquad \text{Equation (2)}$$

Additionally, the first image forming apparatus of the present invention also satisfies the equation (1).

Figure 3A:
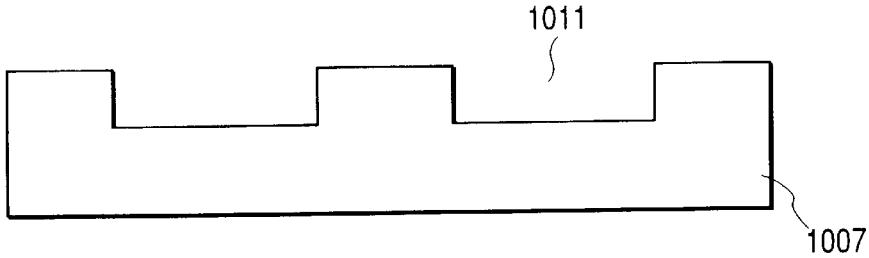
FIGS. 3A, 3B, 3C, 3D and 3E are schematic sectional views showing the process of preparing the face plate and metal back of another embodiment of the present invention.
Figure 3B:
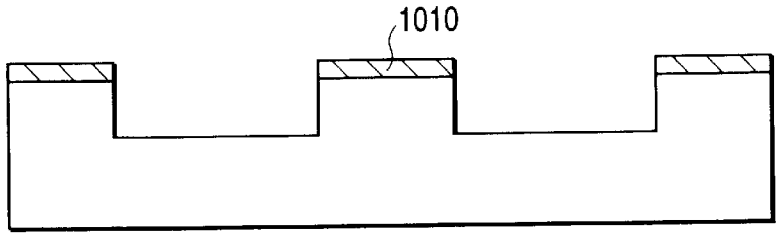
Figure 3C:
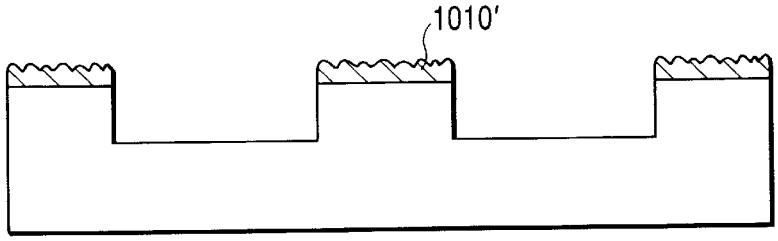
Figure 3D:
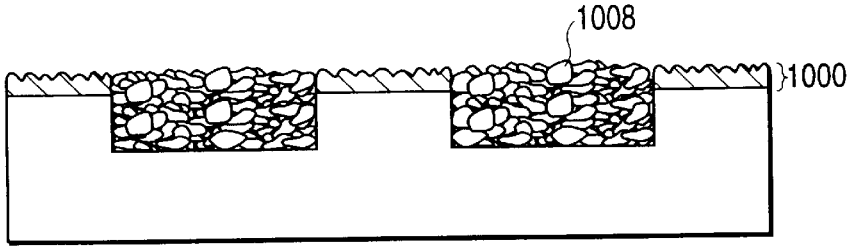
Figure 3E:
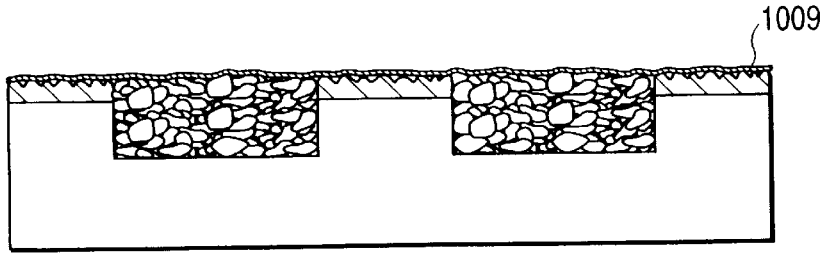

The face plate of the present invention may have a configuration as shown in FIG. 3E. FIG. 3E is a schematic sectional view of the face plate of a second image forming apparatus of the present invention.

As shown in FIGS. 3A to 3E, in the second image forming apparatus of the present invention, a plurality of recesses are formed on the first major surface of the face plate 1007, the recesses are filled with the fluorescent particles, and the fluorescent film 1008 is disposed. Moreover, the interval defining member 1010 is disposed between the fluorescent films 1008. The difference between the average height (average thickness) to the top (surface) of the fluorescent film 1008 from the lowermost layer (bottom surface) of the recess 1011 and the average height (average thickness) to the top (surface) of the interval defining member 1010 from the position corresponding to the lowermost layer (bottom surface) of the recess 1011 is equal to or less than the average particle diameter of the fluorescent particles.

Figure 4A:
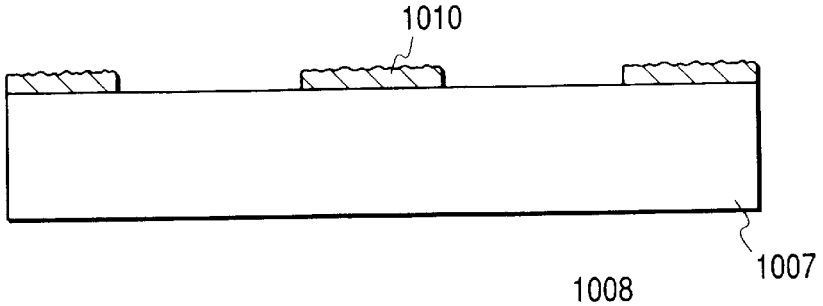
FIGS. 4A, 4B, 4C and 4D are schematic sectional views showing the process of preparing the face plate and metal back of another embodiment of the present invention.
Figure 4B:
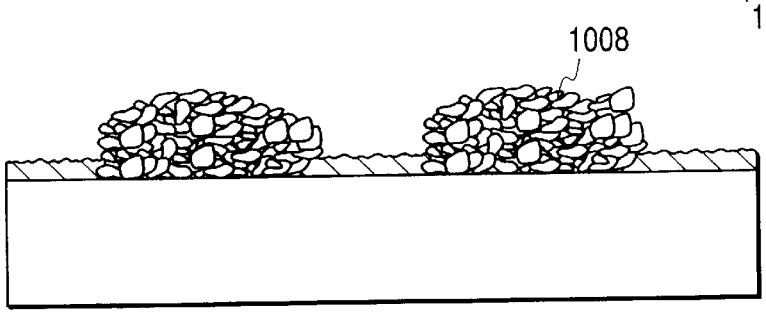
Figure 4C:
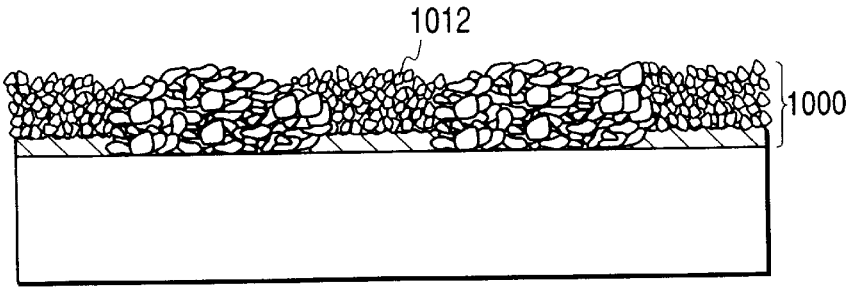
Figure 4D:
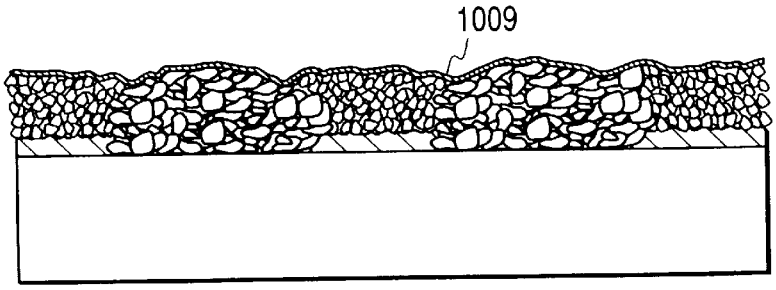

Furthermore, the face plate of the present invention may have a configuration as shown in FIG. 4D. FIG. 4D is a schematic sectional view of the face plate of a third image forming apparatus of the present invention. As shown in FIG. 4D, the face plate includes the first interval defining member 1010, and a second interval defining member 1012 of a material different from that of the first interval defining member may be laminated on the interval defining member 1010. Moreover, in this third constitution, a difference between the average height (average thickness) to the top (surface) of the fluorescent film 1008 from the first major surface of the face plate 1007 and the average height (average thickness) to the top (surface) of the second interval defining member 1012 from the first major surface of the face plate 1007 is equal to or less than the average particle diameter of the fluorescent particles.

Moreover, the second interval defining member 1012 preferably has a diffusion reflectance of 70% or more. In this constitution, the light emitted from the fluorescent material is not absorbed by the second interval defining member, and can efficiently be extracted toward the second major surface, so that the luminance of the image forming apparatus is enhanced. As the material constituting the second interval defining member 1012, magnesium oxide, and boron nitride are preferable.

Moreover, in the process of preparing the conductive member (metal back) 1009, when the resin film covered with the conductive member (metal back) is formed on the member formed of a bulk or very small diameter particles, the gas generated by the thermal decomposition of the resin is not vented during the baking of the resin film. As a result, the lift of the conductive member (metal back) easily occurs. Conversely, when the resin film covered with the conductive member (metal back) is formed on the member formed of very large diameter particles (the flatness of the film is low), the contact portion of the conductive member (metal back) and the fluorescent film (or the fluorescent film and the interval defining member) is remarkably reduced after the baking. As a result, the conductive member (metal back) easily peels by the coulomb attracting force.

Therefore, the second interval defining member 1012 is preferably constituted of the aggregate (group) of particles. Moreover, when the average particle diameter of the particles constituting the second interval defining member is set to rz ($\mu$m), and the average particle diameter of the fluorescent material is rp ($\mu$m), the following is preferably satisfied.

$$0.5\times rp<rz<2\times rp \qquad \text{Equation (3)}$$

In this constitution, since the lift of the conductive member (metal back) does not easily occur during the baking, and a sufficient contact area of the conductive member (metal back) and the fluorescent film (or the fluorescent film and the interval defining member) can be secured, the conductive member (metal back) does not easily peel during generation of the coulomb attracting force.

Figure 5A:
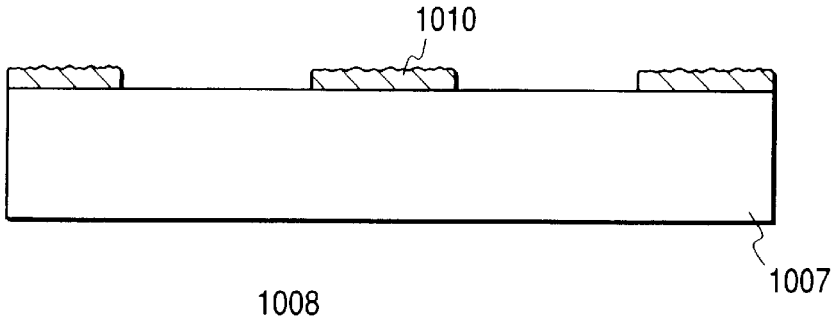
FIGS. 5A, 5B, 5C and 5D are schematic sectional views showing the process of preparing the face plate and metal back of another embodiment of the present invention.
Figure 5B:
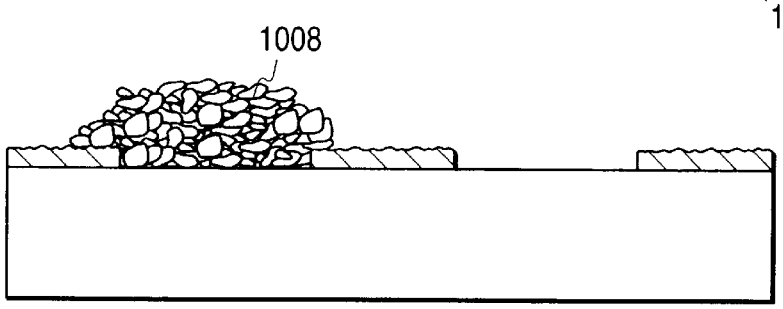
Figure 5C:
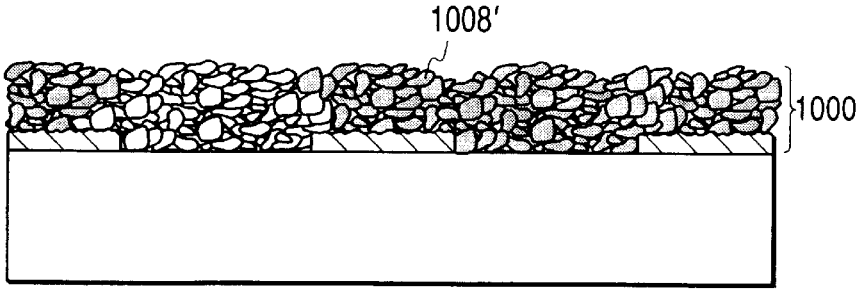
Figure 5D:
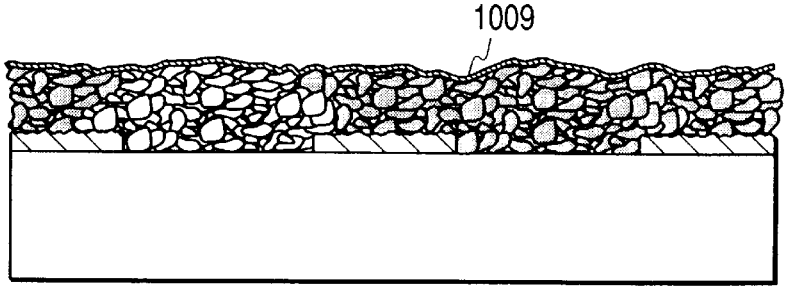
Figure 6A:
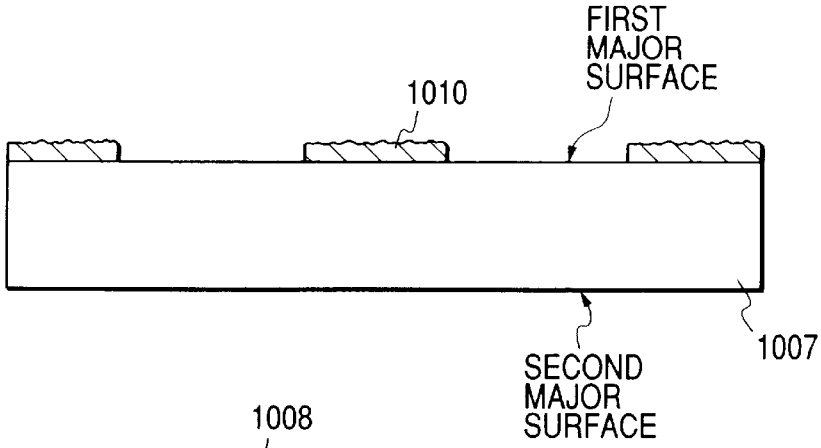
FIGS. 6A, 6B, 6C, 6D and 6E are schematic sectional views showing the process of preparing the face plate and metal back of another embodiment of the present invention.
Figure 6B:
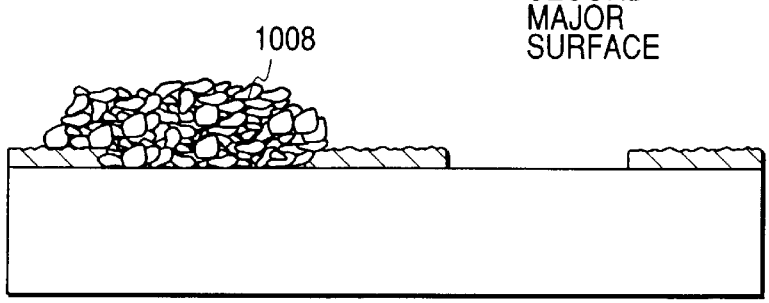
Figure 6C:
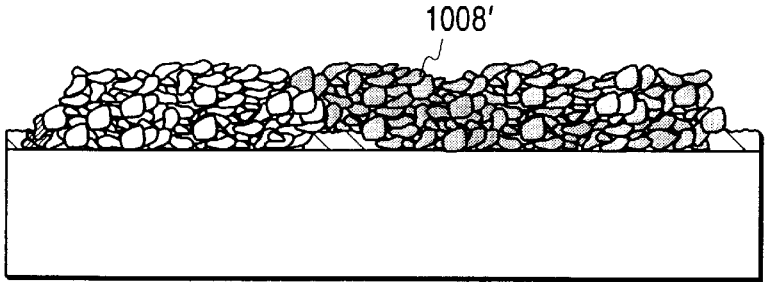
Figure 6D:
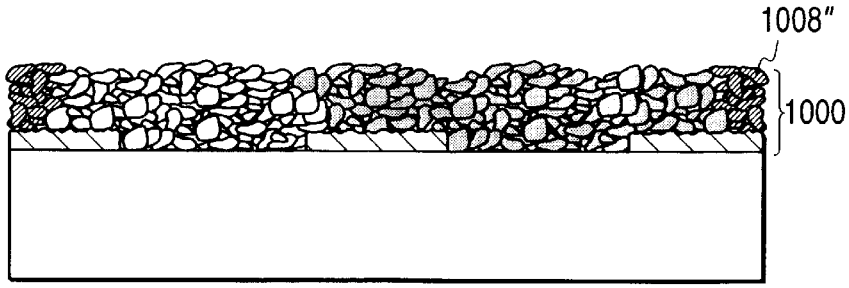
Figure 6E:
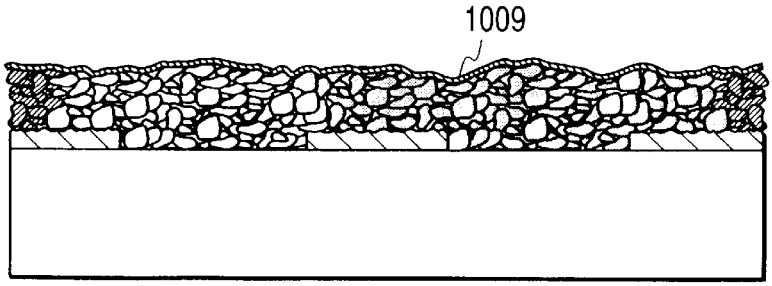
Figure 7A:
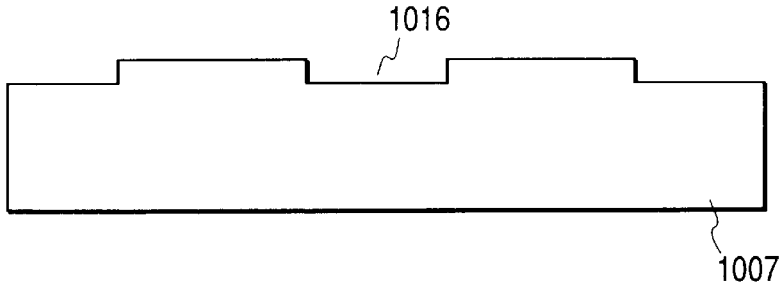
FIGS. 7A, 7B, 7C, 7D and 7E are schematic sectional views showing the process of preparing the face plate and metal back of another embodiment of the present invention.
Figure 7B:
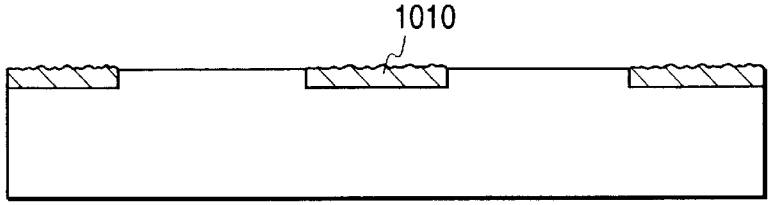
Figure 7C:
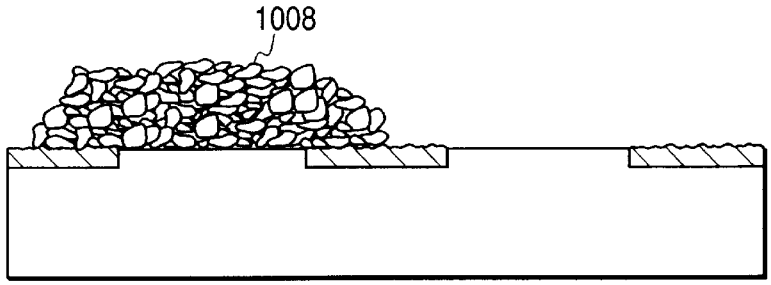
Figure 7D:
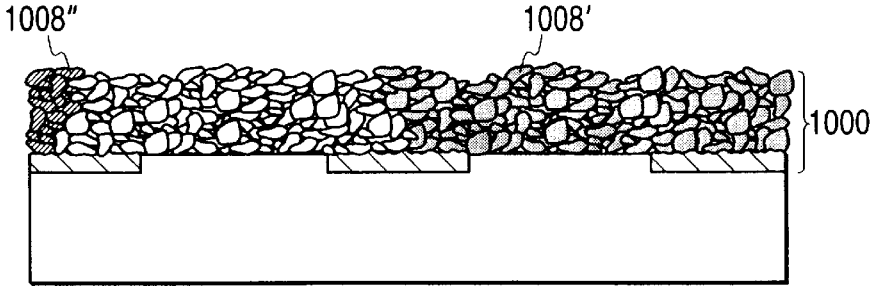
Figure 7E:
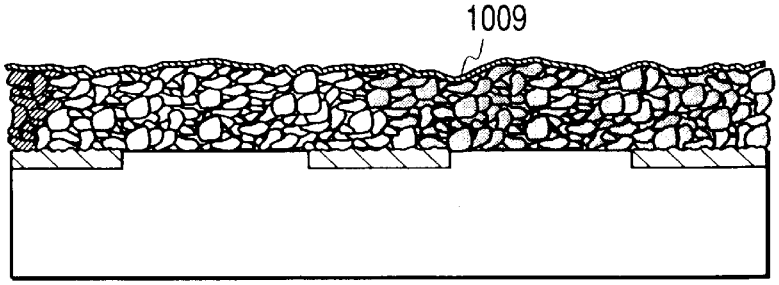

Moreover, the face plate of the image forming apparatus of the present invention may have a configuration as shown in FIGS. 5D, 6E, 7E. FIGS. 5D, 6E, 7E are schematic sectional views of the face plate of a fourth image forming apparatus of the present invention. As shown in FIGS. 5D, 6E, 7E, the face plate includes the interval defining member 1010, and the interval defining member 1010 is preferably covered with one or both of the adjacent fluorescent films. Moreover, in the fourth image forming apparatus of the present invention, a difference between the average height (average thickness) to the top (surface) of the fluorescent film 1008 (1008', 1008") from the first major surface of the face plate 1007 and the average height (average thickness) to the top (surface) of the fluorescent film 1008 (1008', 1008") disposed on the interval defining member 1010 from the first major surface of the face plate is equal to or less than the average particle diameter of the fluorescent particles.

Furthermore, when the top of the interval defining member is covered with the adjacent two-color fluorescent films, the area ratio of two color fluorescent films occupying the top of the interval defining member is preferably in a range of (4 to 9.5):(6 to 0.5). Additionally, the area ratio is preferably in a range of (6 to 9.5):(4 to 0.5).

Moreover, the same color fluorescent film preferably occupies 80% or more of the top of the interval defining member.

In this constitution, it becomes easy to prepare the conductive member (metal back) which has a large contact area with the fluorescent film (or the fluorescent film and the interval defining member), the process of preparing the face plate is further simplified, and the manufacture cost can be reduced.

Moreover, in the fourth image forming apparatus of the present invention, as shown in FIG. 7E, a recess 1016 is formed in the face plate 1007, the recess if filled with the interval defining member 1010, and this configuration is preferable in enhancing the smoothness. In the configuration shown in FIG. 7E, the difference between the average height (average thickness) to the top (surface) of the fluorescent film 1008 (1008', 1008") from the first major surface (surface other than the recess 1016) of the face plate 1007 and the average height (average thickness) to the top (surface) of the fluorescent film 1008 (1008', 1008") disposed on the interval defining member 1010 from the first major surface of the face plate is equal to or less than the average particle diameter of the fluorescent particles.

Furthermore, in the present invention, in any place of the fluorescent layer, a difference between the maximum value and the minimum value of the film thickness of the fluorescent layer in a range of 20 $\mu$m×20 $\mu$m is preferably equal to or less than the average particle diameter of the used fluorescent material.

The above-described invention can solve the following problems.

Specifically, (1) in the process of preparing the conductive member (metal back) 1009, when the difference in height between the fluorescent film 1008 and the interval defining member 1010 is large, during the filming process the resin material is much accumulated in the low portion of the fluorescent film or the interval defining member, and the resin film thickness increases. (2) When the resin material is to be baked and removed after preparing the continuous film of the conductive member on the resin, the amount of the gas generated by the thermal decomposition increases in the thick portion of the resin film, and the lift of the metal back occurs.

According to the present invention which can solve the problem, the adhering force of the conductive member (metal back) 1009 to the fluorescent layer 1000 (fluorescent film, or fluorescent film and interval defining member) can be enhanced. As a result, a highly reliable image forming apparatus can be realized in which the electric discharge is suppressed and stable image formation can be performed over a long time.

According to the above-described image forming apparatus of the present invention, the conductive member (metal back) 1009 contacts the fluorescent layer 1000 (fluorescent film, or fluorescent film and interval defining member) with a sufficient adhering force, and two or more contact portions exist in a range of 20 μm×20 μm in any place of the conductive member (metal back), or 30% or more contact area can be secured.

Moreover, according to the above-described present invention, in the image forming apparatus with an electric field of 1 kV/mm between the rear plate and the face plate, since the contact portion of the conductive member (metal back) and face plate (fluorescent layer) appropriately exists. Therefore, when the coulomb attracting force acts, the force applied to one contact portion is reduced, and the conductive member (metal back) is inhibited from peeling. Even when the electric field intensity as much as 6 kV/mm is applied, the image forming apparatus superior in durability and reliability can be obtained.

Furthermore, according to the above-described present invention, since no resin material is accumulated in the low portion of the fluorescent film or the interval defining member, the lift of the conductive member (metal back) does not easily occur. As a result, since a large contact area of the conductive member (metal back) and fluorescent layer 1000 can be obtained, the conductive member (metal back) can further be inhibited from peeling by the coulomb force.

EXAMPLE 1

The constitution of the face plate and metal back which is the subject of the present invention will next be described with reference to FIGS. 1, 2A to 2D and 10A to 10C.

Figure 2A:
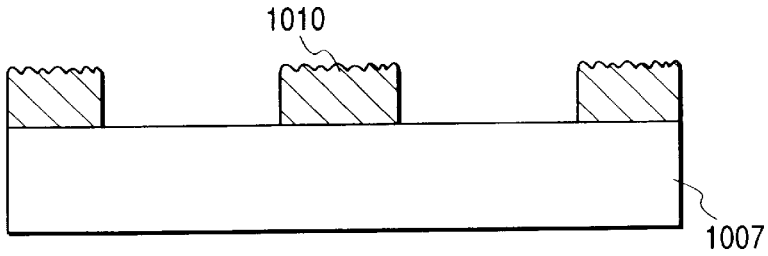
FIGS. 2A, 2B, 2C and 2D are schematic sectional views showing a process of preparing the face plate and metal back of the embodiment of the present invention.

A 2.8 mm thick soda lime glass 1007 was cleaned and dried. Subsequently, a black pigment paste containing glass paste and black pigment was used to prepare the interval defining member on the first major surface of the face plate 1007 by a screen print process in the pattern of FIG. 10A, so that the black matrix was obtained (FIG. 2A). Additionally, the black matrix was patterned to have 240 stripes with a width of 100 μm, pitch of 290 μm in a vertical direction, and 720 stripes with a width of 300 μm, pitch 650 μm in a transverse direction. Additionally, the black matrix was formed in a thickness of 20 μm in both the vertical and transverse directions.

In the present example, the black matrix was prepared by the screen print process, but of course this is not limited, and for example, a photolithography process may be used in preparation, but the screen print process is preferable because the film can be formed to be thick and cost can be reduced. Moreover, the black pigment paste containing the glass paste and black pigment was used as the material of the black matrix, but of course this is not limited, and for example, a carbon black may be used, but the black pigment paste was used because the preparation was performed by the screen print and the film thickness was as much as 20 μm. Furthermore, the black matrix was prepared in a matrix form as shown in FIG. 10A in the present example, but this is not limited, and a striped arrangement, a delta arrangement, or other arrangements may be used.

Figure 2B:
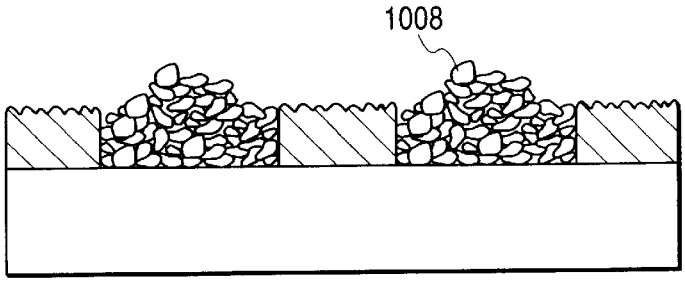

Subsequently, as shown in FIG. 10A, red, blue, green fluorescent pastes were used to prepare the color fluorescent material three times by each of the three colors in the openings of the black matrix by the screen print process. In the present example, the fluorescent film was formed using the screen print process, but of course this is not limited, and for example, the preparation may be performed by the photolithography process. Moreover, for the fluorescent material, a fluorescent material P22 used in the CRT field was used. Red (P22-RE3; $Y202S:Eu^{3+}$), blue (P22-B2; ZnS:Ag, Al), green (P22-GN4; ZnS:Cu, Al) were used. The average particle diameter was 7 μm in terms of the median diameter Dmed. Of course, this is not limited, and other fluorescent materials may be used. Moreover, the fluorescent layer was prepared so as to provide an average film thickness of about 20 μm. Here, when the film thickness of the fluorescent film 1008 is not sufficiently flat as shown in FIG. 2B, the flatness may be increased as shown in FIG. 2C by disposing a nonwoven fabric with isopropyl alcohol (IPA) absorbed therein on a flat glass having a sufficient flatness, and pressurizing the fluorescent film and black matrix on the face plate.

Figure 2C:
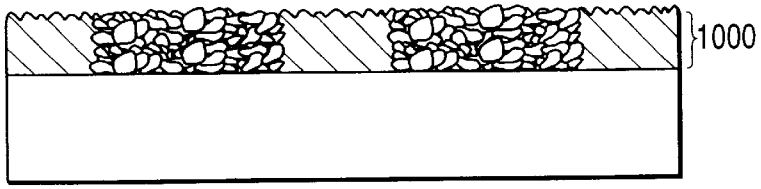

Subsequently, by baking the substrate at 450° C. for four hours, the resin content in the paste was thermally decomposed and removed, so that the face plate with a diagonal screen size of 10 inches, aspect ratio of 4:3, and the number of pixels 720×240 was obtained (FIG. 2C). Here, when the thickness of the fluorescent layer and black matrix was measured using the probe type surface roughness meter, a place was not observed where the difference between the average thickness of the fluorescent film in one pixel and the average thickness of the adjacent black matrix exceeded the average particle diameter of the fluorescent material of 7 μm. Moreover, even when the area of all pixels was measured, the place where the difference exceeded the fluorescent material average particle diameter of 7 μm was not observed.

Figure 2D:
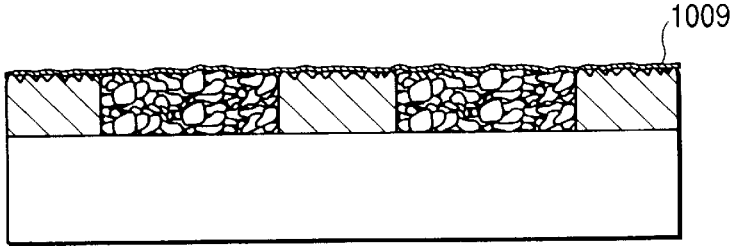

A method of forming the metal back on the face plate will next be described. After disposing the face plate prepared as described above on a spin coater, and applying a solution of colloidal silica dissolved in pure water to the rotated face plate substrate, the surface irregularities of the fluorescent layer 1000 were wetted. Subsequently, by spraying and applying a solution of polymethacrylate dissolved in toluene uniformly to the entire surface of the rotated face plate substrate, and applying hot air to the substrate to dry the substrate, the resin film was formed on the fluorescent film 1008 and black matrix 1010, so that the surface was flatted. Here, the flatting process comprises wetting the fluorescent layer 1000 and subsequently applying the solution of polymethacrylate dissolved in toluene. Of course, this is not limited, and other solvent lacquer solutions may be used, and a process of applying an acrylic emulsion to the fluorescent material and drying the material may be performed as other methods. Thereafter, the aluminum film 1009 with 1000 angstroms was formed on the flatted face plate by the vacuum evaporation process. Subsequently, the face plate was conveyed into a calcining furnace, and heated to 450° C. to thermally decompose and remove the resin film (FIG. 2D).

The face plate obtained as described above was observed with a scan electronic microscope (SEM), and the contact portion of the metal back, fluorescent material and black matrix was observed. In this case, when the observation is performed with a high acceleration voltage, it is difficult to observe the metal back with a thickness of 1000 angstroms. Therefore, the observation was performed with an acceleration voltage of 2 kV. When the metal back is observed with the SEM, the metal back of the contact portion is formed along the surface shape of the fluorescent film or black matrix, and the contact portion can effectively be observed.

The number of contact portions in a range of 20 $\mu$m×20 $\mu$m and the contact area were measured by the observation of the SEM. The measurement was performed in the opening of the selected black matrix, eight adjacent black matrix openings and the range surrounded by the openings, and N=10 places were extracted at random from the entire surface of the face plate and measured.

Results are shown in Table 1. As a result of the observation, there was no place where the number of metal back contact portions in the range of 20 $\mu$m×20 $\mu$m was less than two, and it was observed that the contact portions satisfactorily contacted the face plate.

Moreover, by fixing the above-described face plate opposite to an electrode sufficiently larger than the face plate with a constant gap in a vacuum chamber, applying a high voltage to the metal back with DC to gradually raise the applied voltage, and measuring the voltage at which the electric discharge was started, the electric field intensity (hereinafter referred to as the discharge start electric field intensity) was obtained. Here, the electric field intensity is obtained by dividing the voltage applied to the metal back by a gap distance between the rear plate and the face plate. As the measurement result, the discharge start electric field intensity was 7.7 kV/mm (results are shown in Table 1). As described above, the face plate placed in satisfactory contact with the metal back could be obtained.

TABLE 1

| | Ex. 1 | Ex. 2 | Ex. 3 | Ex. 4 | Ex. 5 | Ex. 6 | Com. Ex. |
|---|---|---|---|---|---|---|---|
| No. of contacts Minimum value (No./20 $\mu$m × 20 $\mu$m) | 5 | 5 | 4 | 2 | 3 | 4 | 0 |
| No. of contacts Average value (No./20 $\mu$m × 20 $\mu$m) | 11.4 | 13.2 | 10.2 | 6.8 | 8.3 | 10.5 | 5.2 |
| Contact area ratio (%) | 55 | 42 | 39 | 34 | 32 | 37 | 12 |
| Discharge start field intensity (kV/mm) | 7.7 | 8.3 | 7.3 | 6.5 | 6.7 | 7.2 | 4.5 |

The constitution and manufacture method of the image forming apparatus prepared using the face plate prepared in the present example will next be described.

FIG. 9 is a perspective view of a display panel for use in the present example, and a part of the panel is cut to show the inner structure.

In FIG. 9, the rear plate 1005, the outer frame 1006, and the face plate 1007 forms a hermetically sealed container which maintains the inside of the display panel in vacuum. Numeral 1000 denotes the fluorescent layer, and 1009 denotes the metal back.

When the hermetically sealed container is assembled, sealing is necessary to hold sufficient intensity and hermetic property in each member bonded portion. In the present example, the sealing was attained by applying a frit glass to the bonded portion, and performing baking at 400 to 500° C. for ten or more minutes in the atmospheric air or nitrogen atmosphere.

An electron source substrate 1001 is fixed to the rear plate 1005, and N×M surface conduction electron emitting devices 1002 are formed on the substrate. (N, M are positive integers of 2 or more, and appropriately set in accordance with the number of target display pixels. In the present example, N=720, M=240.) The N×M surface conduction electron emitting devices are wired in a simple matrix by M row direction wirings 1003 and N column direction wirings 1004. The part constituted by the above-described components 1001 to 1004 is called the multi-electron beam source.

In the present example, the multi-electron beam source substrate 1001 is fixed to the rear plate 1005 of the hermetically sealed container. When the multi-electron beam source substrate 1001 has a sufficient intensity, the multi-electron beam source substrate 1001 itself may be used as the rear plate of the hermetically sealed container. Moreover, in the present example, the surface conduction electron emitting device is used as the electron emitting device, but the present invention is not limited to this. For example, the above-described field emitter (FE), MIM type electron emitting device, thermionic cathode, and the like may be used.

In the present example, the black matrix type shown in FIG. 10A is used as the pattern of the fluorescent film, but the present invention is not limited to the striped arrangement, and for example, the delta arrangement shown in FIG. 10B, and other arrangements may be used.

Moreover, electric connection terminals Dx1 to Dxm, Dy1 to Dyn and Hv of the hermetically sealed structure are disposed to electrically connect the display panel and an electric circuit (not shown). The terminals Dx1 to Dxm are electrically connected to the row direction wiring 1003 of the multi-electron beam source, Dy1 to Dyn are connected to the column direction wiring 1004 of the multi-electron beam source, and Hv is connected to the metal back 1009 of the face plate.

Moreover, the inside of the container sealed by the sealing process needs to be evacuated to provide high vacuum. Therefore, after assembling (sealing) the container, an exhaust tube (not shown) and a vacuum pump were connected, and the hermetically sealed container was evacuated to provide a vacuum degree of about $10^{-7}$ Torr.

Thereafter, the exhaust tube is sealed. In order to maintain the vacuum in the hermetically sealed container, after sealing the exhaust tube, a getter film (not shown) was formed on a predetermined position in the hermetically sealed container. The getter film is formed, for example, by heating and depositing a getter material mainly containing Ba with a heater or by high-frequency heating, and the inside of the hermetically sealed container is maintained to a vacuum degree of $1\times10^{-5}$ to $1\times10^{-7}$ Torr by the adsorption action of the getter film.

When the image forming apparatus formed as described above was driven, a stable high-luminance image was obtained over a long time without causing the electric discharge supposedly by the peeled metal back.

EXAMPLE 2

The present example will next be described with reference to FIGS. 3A to 3E and 10A to 10C.

After cleaning and drying a 2.8 mm thick soda lime glass similar to that of the first example, as shown in FIG. 10A, an about 17 $\mu$m deep recess 1011 is formed on the face plate glass corresponding to the black matrix opening by a sand blast process (FIG. 3A). In the present example, the recess 1011 of the face plate was formed by the sand blast process. Of course, this is not limited, and the recess may be formed, for example, by wet etching or the like. Subsequently, this face plate was cleaned. The cleaning comprises first spraying dry air to blow dust, and the like, subsequently performing shower-cleaning with pure water, and drying the face plate.

Subsequently, in a similar method as the first example, the black matrix 1010 was formed in a thickness of 3 μm on the area other than the recesses of the face plate (FIG. 3B). Here, to form the black matrix, in the present example, after forming the recesses of the face plate, the black matrix was formed, but of course, this is not limited. The method may comprise: applying the black matrix material to the entire surface of the image area of the face plate, forming the recesses of the face plate, and simultaneously forming the black matrix openings.

Next, a surface treatment was performed on the black matrix 1010. When the black matrix has a high smoothness, and the adhesion of the black matrix and metal back is deteriorated after baking the film in the filming process, the smoothness of the black matrix surface is preferably lowered. In the present example, the surface smoothness was lowered by washing the black matrix portion with an etching solution, so that the adhesion of the black matrix and metal back was enhanced (FIG. 3C), but of course, this is not limited. The surface treatment may be performed by the sand blast process, or the surface smoothness may be changed by mixing black particles with a particle diameter similar to that of the fluorescent material into the black matrix material.

Subsequently, in a similar manner as the first example, the three color fluorescent materials were used to form the fluorescent film 1008 in the arrangement as shown in FIG. 10A (FIG. 3D). When the film thickness and surface roughness of the formed face plate were measured by the probe type surface roughness meter, there was observed no place where the difference between the average height of the fluorescent film in one pixel and the average height of the adjacent black matrix exceeded the average particle diameter of the fluorescent material of 7 μm. Moreover, even when the measurement was performed over the area of all pixels, no place where the difference exceeded the fluorescent material average particle diameter of 7 μm was observed. Additionally, the measurement was performed using the bottom of the recess as the criterion of the height during the measurement.

Subsequently, the metal back was formed on the face plate in the similar method as the first example, and the face plate was obtained (FIG. 3E).

The face plate prepared as described above was observed with the SEM in the similar manner as the first example, and the number of contact portions in the range of 20 μm×20 μm and the contact area were measured. Results are shown in Table 1. As the observation result, there was no place where the number of metal back contact portions in the range of 20 μm×20 μm was less than two, and it was observed that the contact portions satisfactorily contacted the face plate. When the discharge start electric field intensity was observed similarly to the first example, it was 8.3 kV/mm (results are shown in Table 1). When the above-described face plate and the rear plate provided with the multi-electron beam source similar to that of the first example were used to prepare the image display, similarly to the first example, the durability and reliability of the image display could be enhanced.

EXAMPLE 3

The present example will next be described with reference to FIGS. 4A to 4D and 10A to 10C.

After cleaning and drying the 2.8 mm thick soda lime glass 1007 similar to that of the first example, in the similar manner as the first example, a 3 μm thick first interval defining member (black matrix) 1010 was prepared (FIG. 4A). Subsequently, similarly to the first example, three color fluorescent materials were used to form the 20 μm thick fluorescent film 1008 in the black matrix opening in the arrangement as shown in FIG. 10A (FIG. 4B). Here, even when the fluorescent material is slightly laminated on the black matrix, the black matrix absorbs light, thereby causing no color mixture.

A process of disposing the second interval defining member 1012 on the black matrix to reduce the surface irregularities of the face plate will next be described. Main object of this second interval defining member 1012 is to increase the contact portions of the metal back 1009. When the surface irregularities of the face plate exist, the lift of the metal back easily occurs. Therefore, the surface irregularities need to be reduced.

Moreover, here, when the surface of the second interval defining member 1012 is excessively smooth, the adhesion of the black matrix and metal back is possibly deteriorated after calcining the resin film in the filming process. Conversely, when the surface irregularities are excessively large, the contact portions of the metal back are reduced, and the metal back possibly forms no continuous film. Therefore, the average particle diameter of the material used in the second interval defining member 1012 is preferably taken into consideration.

Furthermore, when the second interval defining member 1012 has an absorbency, the light emitted from the fluorescent material is absorbed, and the efficiency of the light extracted toward the second major surface of the face plate 1007 is lowered. Therefore, the diffusion reflectance of the material is preferably 70% or more.

Therefore, in the present example the magnesium oxide powder with an average particle diameter of 4 μm was used in consideration of the above-described reason. This was dispersed in a resin binder, a magnesium oxide paste was prepared, a 20 μm thick film was formed on the glass substrate, and the diffusion reflectance was measured, so that a favorable value of about 85% was obtained. In the present example the magnesium oxide powder with the average particle diameter of 4 μm was used as the material of the second interval defining member 1012, but of course this is not limited, and for example, boron nitride or the like may be used as long as the above-described requirement is satisfied. The above-described magnesium oxide paste was used to form the second interval defining member on the black matrix by the screen print process (FIG. 4C).

In the present example, the second interval defining member was prepared by the screen print process, but of course this is not limited, and for example, the photolithography process or the like may be used for the preparation.

Here, similarly to the first example, when the film thickness of the fluorescent film 1008 and second interval defining member 1012 is insufficiently flat, the flatness may be enhanced by disposing the nonwoven fabric with isopropyl alcohol (IPA) absorbed therein on the flat glass having a sufficient flatness, and pressurizing the fluorescent film on the face plate and the second interval defining member on the black matrix.

Subsequently, by baking the substrate at 450° C. for four hours, and thermally decomposing and removing the resin content in the paste, the face plate was obtained.

When the film thickness and surface roughness of the prepared face plate were measured by the probe type surface roughness meter, there was observed no place where the difference between the average height of the fluorescent film in one pixel and the average height of the adjacent black matrix exceeded the fluorescent material average particle diameter of 7 μm. Moreover, even when the measurement was performed over the area of all pixels, no place where the difference exceeded the fluorescent material average particle diameter of 7 μm was observed.

Additionally, the measurement was performed using the first major surface of the face plate 1007 as the criterion of the height during the measurement.

Subsequently, the metal back was formed on the face plate in the similar method as the first example, and the face plate was obtained (FIG. 4D).

The face plate prepared as described above was observed with the SEM in the similar manner as the first example, and the number of contact portions in the range of 20 μm×20 μm and the contact area were measured. Results are shown in Table 1. As the observation result, there was no place where the number of metal back contact portions in the range of 20 μm×20 μm was less than two, and it was observed that the contact portions satisfactorily contacted the face plate. When the discharge start electric field intensity was observed similarly to the first example, it was 7.3 kV/mm (results are shown in Table 1). When the above-described face plate and the rear plate provided with the multi-electron beam source similar to that of the first example were used to prepare the image display, similarly to the first example, the durability and reliability of the image display could be enhanced. Moreover, since the laminate of magnesium oxide was disposed on the black matrix to enhance the light use efficiency, during the driving under the conditions similar to those of the first example, the luminance of the image display was enhanced by about 10%.

EXAMPLE 4

A fourth example will next be described with reference to FIGS. 5A to 5D and 10A to 10C.

After cleaning and drying the 2.8 mm thick soda lime glass similar to that of the first example, in the similar method as the first example, a 3 μm thick black matrix 1010 was prepared (FIG. 5A).

Subsequently, three color fluorescent films 1008 were formed in the black matrix openings in the arrangement as shown in FIG. 10A. The preparation of the fluorescent film is performed by the screen print process, and the fluorescent material is prepared three times by each of the three colors. Here, the first two color materials were prepared similarly to the third example (FIG. 5D). The third color material was also laminated on the black matrix 1010 to reduce the surface irregularities of the face plate (FIG. 5C).

Here, similarly to the first example, when the film thickness of the fluorescent material is insufficiently flat, the flatness may be enhanced by disposing the nonwoven fabric with isopropyl alcohol (IPA) absorbed therein on the flat glass having a sufficient flatness, and pressurizing the fluorescent film on the face plate.

Subsequently, by baking the substrate at 450° C. for four hours, and thermally decomposing and removing the resin content in the paste, the face plate was obtained.

When the film thickness and surface roughness of the prepared face plate were measured by the probe type surface roughness meter, there was observed no place where the difference between the average height of the fluorescent film in one pixel and the average height of the fluorescent material on the adjacent black matrix exceeded the fluorescent material average particle diameter of 7 μm. Moreover, even when the measurement was performed over the area of all pixels, no place where the difference exceeded the fluorescent material average particle diameter of 7 μm was observed. Additionally, the measurement was performed using the first major surface of the face plate 1007 as the criterion of the height during the measurement.

Moreover, when the face plate was observed with an optical microscope, the finally printed fluorescent material occupying the area of 80% or more was present on the black matrix.

Subsequently, the metal back was formed on the face plate in the similar method as the first example, and the face plate was obtained (FIG. 5D).

The face plate prepared as described above was observed with the SEM similarly to the first example, and the number of contact portions in the range of 20 μm×20 μm and the contact area were measured. Results are shown in Table 1. As the observation result, there was no place where the number of metal back contact portions in the range of 20 μm×20 μm was less than two, and it was observed that the contact portions satisfactorily contacted the face plate. When the discharge start electric field intensity was observed similarly to the first example, it was 6.5 kV/mm (results are shown in Table 1). When the abovedescribed face plate and the rear plate provided with the multi-electron beam source similar to that of the first example were used to prepare the image display, similarly to the first example, the durability and reliability of the image display could be enhanced.

EXAMPLE 5

A fifth example will next be described with reference to FIGS. 6A to 6E and 10C.

After cleaning and drying the 2.8 mm thick soda lime glass 1007 similar to that of the first example, in the similar method as the first example, a 3 μm thick black stripe 1010 was prepared (FIGS. 6A, 10C).

Subsequently, three color fluorescent films 1008 were formed in the openings of the black stripe 1010 in the arrangement as shown in FIG. 10C. The preparation of the fluorescent film is performed by the screen print process, and the fluorescent material is prepared three times by each of the three colors. Moreover, for the pattern of printing the fluorescent material, instead of printing dots in the positions of the black matrix openings, the printing is performed so that the fluorescent film 1008 is striped as shown in FIG. 10C.

First, when the first color fluorescent film 1008 was printed, the printing was performed so that the film protruded onto the adjacent black stripe by substantially the half (FIG. 6B). Subsequently, to print a second color fluorescent film 1008', the printing was performed so that the second color fluorescent film 1008' overlapped the portion of the adjacent black stripe covered with the first color fluorescent film, and protruded onto the other black stripe by substantially the half (FIG. 6C).

Subsequently, the third color fluorescent film 1008" was printed so as to be overlapped with the adjacent black stripe (FIG. 6D).

Here, similarly to the first example, when the film thickness of the fluorescent film 1008 is not sufficiently flat, the flatness may be increased by disposing the nonwoven fabric with isopropyl alcohol (IPA) absorbed therein on a flat glass having a sufficient flatness, and pressurizing the fluorescent film on the face plate.

Subsequently, by baking this substrate at 450° C. for four hours, the resin content in the paste was thermally decomposed and removed, so that the face plate was obtained.

When the thickness and surface roughness of the face plate prepared as described above were measured using the probe type surface roughness meter, there was observed no place where the difference between the average height of the fluorescent film in one pixel and the average height of the fluorescent material on the adjacent black stripe exceeded the fluorescent material average particle diameter of 7 μm. Moreover, even when the area of all pixels was measured, the place where the difference exceeded the fluorescent material average particle diameter of 7 μm was not observed. Additionally, the measurement was performed using the first major surface of the face plate 1007 as the criterion of the height during the measurement. Moreover, when the face plate was observed with the optical microscope, the black stripe was covered with both adjacent pixel fluorescent materials.

Subsequently, the metal back 1009 of aluminum was formed on the face plate in the similar method as the first example, and the face plate was obtained (FIG. 6E).

The face plate prepared as described above was observed with the SEM similarly to the first example, and the number of contact portions in the range of 20 μm×20 μm and the contact area were measured. Results are shown in Table 1. As the observation result, there was no place where the number of metal back contact portions in the range of 20 μm×20 μm was less than two, and it was observed that the contact portions satisfactorily contacted the face plate. When the discharge start electric field intensity was observed similarly to the first example, it was 6.7 kV/mm (results are shown in Table 1). When the abovedescribed face plate and the rear plate provided with the multi-electron beam source similar to that of the first example were used to prepare the image display, similarly to the first example, the durability and reliability of the image display could be enhanced.

EXAMPLE 6

A sixth example of the present invention will next be described with reference to FIGS. 7A to 7E and 10A to 10C.

After cleaning and drying the 2.8 mm thick soda lime glass 1007 similar to that of the first example, in the similar method as the second example, a 3 μm deep recess 1016 was formed in the area of the black stripe 1010 shown in FIG. 10C (FIG. 7A). Subsequently, the substrate was cleaned and dried in the similar method as the second example.

Subsequently, the recess 1016 of the face plate was filled with the 3 μm thick black stripe 1010 in the similar method as the first example (FIG. 7B).

Next, three color fluorescent films 1008 were formed in the openings of the black stripe 1010 in the arrangement as shown in FIG. 10C. The preparation of the fluorescent films 1008 was performed by the screen print process, and the fluorescent material was prepared three times by each of the three colors.

First, when the first color fluorescent film 1008 was printed, the printing was performed so that the film protruded onto the adjacent black stripe 1010 by substantially 70% (FIG. 7C).

Subsequently, to print the second color fluorescent film 1008', the printing was performed so that the second color fluorescent film 1008' overlapped the side of the adjacent black stripe covered with the first color fluorescent film 1008, and protruded onto the other black stripe by substantially 70%.

Subsequently, the third color fluorescent film 1008" was printed so as to entirely cover the portion of the adjacent black stripe 1010 not covered with the fluorescent film (FIG. 7D).

Here, similarly to the first example, when the film thickness of the fluorescent film (1008, 1008', 1008") is not sufficiently flat, the flatness may be increased by disposing the nonwoven fabric with isopropyl alcohol (IPA) absorbed therein on the flat glass having a sufficient flatness, and pressurizing the fluorescent film on the face plate.

Subsequently, by baking this substrate at 450° C. for four hours, the resin content in the paste was thermally decomposed and removed, so that the face plate was obtained.

When the thickness and surface roughness of the face plate prepared as described above were measured using the probe type surface roughness meter, there was observed no place where the difference between the average height of the fluorescent film in one pixel and the average height of the fluorescent film on the adjacent black stripe exceeded the fluorescent material average particle diameter of 7 μm. Moreover, even when the area of all pixels was measured, the place where the difference exceeded the fluorescent material average particle diameter of 7 μm was not observed. Additionally, the measurement was performed using the bottom surface of the recess formed in the face plate 1007 as the criterion of the height during the measurement. Moreover, when the face plate was observed with the optical microscope, the black stripe was covered with both adjacent sub-pixel fluorescent films.

Subsequently, the metal back was formed on the face plate in the similar method as the first example, and the face plate was obtained (FIG. 7E).

The face plate prepared as described above was observed with the SEM similarly to the first example, and the number of contact portions in the range of 20 μm×20 μm and the contact area were measured. Results are shown in Table 1. As the observation result, there was no place where the number of metal back contact portions in the range of 20 μm×20 μm was less than two, and it was observed that the contact portions satisfactorily contacted the face plate. When the discharge start electric field intensity was observed similarly to the first example, it was 7.2 kV/mm (results are shown in Table 1). When the above-described face plate and the rear plate provided with the multi-electron beam source similar to that of the first example were used to prepare the image display, similarly to the first example, the durability and reliability of the image display could be enhanced.

Comparative Example

A comparative example of the present invention will next be described with reference to FIGS. 8A to 8C and 10A to 10C.

Figure 8A:
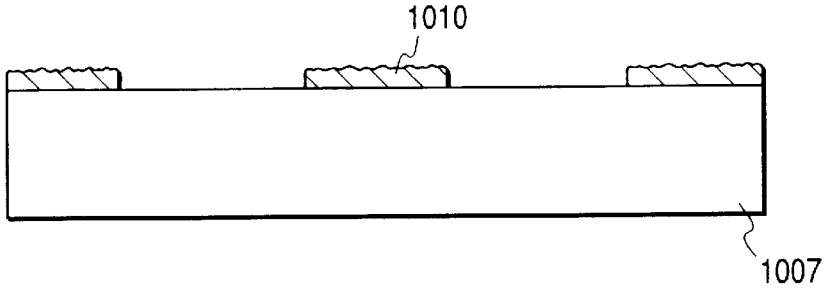
FIGS. 8A, 8B and 8C are schematic sectional views showing the process of preparing the face plate and metal back of a comparative example in the present invention.

After cleaning and drying the 2.8 mm thick soda lime glass 1007 similar to that of the first example, in the similar method as the first example, the 3 μm thick black matrix 1010 was prepared (FIG. 8A).

Figure 8B:
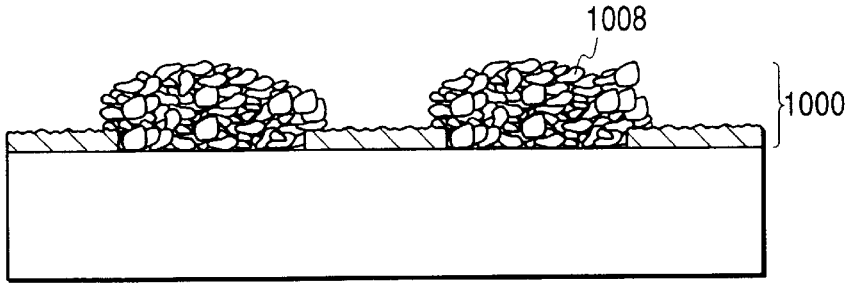

Subsequently, similarly to the first example, three color fluorescent films 1008 were formed in a thickness of 20 μm in the openings of the black matrix 1010 in the arrangement shown in FIG. 10A (FIG. 8B).

Subsequently, by calcining this substrate at 450° C. for four hours, the resin content in the paste was thermally decomposed and removed, so that the face plate was obtained.

When the thickness and surface roughness of the face plate prepared as described above were measured using the probe type surface roughness meter, the difference between the average height of the fluorescent film in one pixel and the average height of the adjacent black matrix exceeded the fluorescent material average particle diameter of 7 μm in most parts.

Figure 8C:
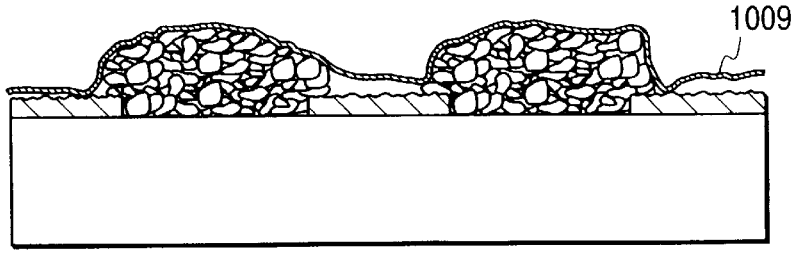

Subsequently, the metal back was formed on the face plate in the similar method as the first example, and the face plate was obtained (FIG. 8C).

The face plate prepared as described above was observed with the SEM similarly to the first example, and the number of contact portions in the range of 20 μm×20 μm and the contact area were measured. Results are shown in Table 1. As the observation result, there were a multiplicity of places on the black matrix, where the metal back contact portions occupied less than 30% in the range of 20 μm×20 μm, and it was observed that the metal back was lifted.

When the discharge start electric field intensity was observed similarly to the first example, it was 4.5 kV/mm (results are shown in Table 1). When the above-described face plate and the rear plate provided with the multi-electron beam source similar to that of the first example were used to prepare the image display, and the display was compared as the above-described examples, the metal back peeled by the coulomb force, null portions were generated in the pixels, electric discharge frequently occurred, and the durability and reliability were inferior to those of the examples.

As described above, according to the present invention, in the structure in which the electric field intensity between the rear plate and the face plate of the image display is 1 kV/mm or more, the metal back satisfactorily contacts the face plate. Therefore, when a high voltage is applied to the metal back, the metal back is prevented from peeling by the coulomb attracting force exerted to the metal back. Without generating the pixel null portions by the peeled metal back, or causing the electric discharge by the peeled metal back having reached the rear plate, the image display with the enhanced durability and reliability can be obtained.

What is claimed is:

1. An image forming apparatus comprising:

a rear plate having an electron emitting device; and a face plate having a substrate, a fluorescent layer disposed on the substrate and a conductive film disposed on said fluorescent layer, wherein said fluorescent layer comprises fluorescent particles, wherein when an average thickness of said fluorescent layer in one pixel is set to d, an average particle diameter of said fluorescent particles is rp, and the thickness of the fluorescent film in one sub-pixel of said fluorescent layer is D, $D-rp<d<D+rp$ is satisfied, wherein said fluorescent layer comprises a fluorescent film and an interval defining member adjacent to said fluorescent film, and said interval defining member is covered with said adjacent fluorescent film, and wherein said fluorescent film comprises fluorescent films of three colors, and said fluorescent film covering said interval defining member occupies 80% or more of said interval defining member by a fluorescent film of one color of said three colors.

2. An image forming apparatus comprising:

a rear plate having an electron emitting device; and a face plate having a substrate, a fluorescent layer disposed on the substrate and a conductive film disposed on said fluorescent layer, wherein said fluorescent layer comprises fluorescent particles, wherein when an average thickness of said fluorescent layer in one pixel is set to d, an average particle diameter of said fluorescent particles is rp, and the thickness of the fluorescent film in one sub-pixel of said fluorescent layer is D, $D-rp<d<D+rp$ is satisfied, wherein said fluorescent layer comprises a fluorescent film and an interval defining member adjacent to said fluorescent film, and said interval defining member is covered with said adjacent fluorescent film, and wherein said adjacent fluorescent film comprises two different types of fluorescent films, and an area ratio of said two types of fluorescent films covering said interval defining member is in a range of (4 to 9.5):(6 to 0.5).

3. An image forming apparatus comprising:

a rear plate having an electron emitting device; and a face plate having a conductive film, and a fluorescent layer comprising fluorescent particles, said conductive film being disposed on said fluorescent layer, wherein when an average thickness of said fluorescent layer is set to d, an average particle diameter of said fluorescent particles is rp, and the thickness of the fluorescent layer is D, $D-rp<d<D+rp$ is satisfied, wherein said fluorescent layer comprises a fluorescent film and an interval defining member adjacent to said fluorescent film, and said interval defining member is covered with said adjacent fluorescent film, and wherein said fluorescent film comprises fluorescent films of three colors, and said fluorescent film covering said interval defining member occupies 80% or more of said interval defining member by a fluorescent film of one color of said three colors.

4. An image forming apparatus comprising:

a rear plate having an electron emitting device; and a face plate having a conductive film, and a fluorescent layer comprising fluorescent particles, said conductive film being disposed on said fluorescent layer, wherein when an average thickness of said fluorescent layer is set to d, an average particle diameter of said fluorescent particles is rp, and the thickness of the fluorescent layer is D, $D-rp<d<D+rp$ is satisfied, wherein said fluorescent layer comprises a fluorescent film and an interval defining member adjacent to said fluorescent film, and said interval defining member is covered with said adjacent fluorescent film, and wherein said adjacent fluorescent film comprises two different types of fluorescent films, and an area ratio of said two types of fluorescent films covering said interval defining member is in a range of (4 to 9.5):(6 to 0.5).

5. The image forming apparatus according to claim 1, 2, 3 or 4, wherein when the average thickness of said fluorescent film is set to tp, and the average thickness of said interval defining member is tb; $tp-rp<tb<tp+rp$ is satisfied.

6. The image forming apparatus according to claim 1, 2, 3 or 4, wherein said interval defining member comprises a first interval defining member and a second interval defining member formed of a material different from the material of the first interval defining member, and said second interval defining member is laminated on said first interval defining member.

7. The image forming apparatus according to claim 6, wherein said second interval defining member comprises a particle aggregate, and when the average particle diameter of particles constituting said second interval defining member is set to rz, $0.5 \times rp < rz < 2 \times rp$ is satisfied.

8. The image forming apparatus according to claim 7, wherein a diffusion reflectance of said second interval defining member is 70% or more.

9. The image forming apparatus according to claim 6, wherein a diffusion reflectance of said second interval defining member is 70% or more.

10. The image forming apparatus according to claim 1, 2, 3 or 4, wherein said face plate comprises a plurality of recesses, and the recesses are filled with a part of said fluorescent layer.

11. The image forming apparatus according to claim 10, wherein said recesses are filled with said fluorescent film.

* * * * *